US006003729A

United States Patent [19]

Berkus

[11] Patent Number: 6,003,729

[45] Date of Patent: Dec. 21, 1999

[54] DEVICE FOR SQUEEZING A VISCOUS LIQUID FROM A TUBE DISPENSER

[76] Inventor: Clyde C. Berkus, 3148 Abington Dr., Beverly Hills, Calif. 90210

[21] Appl. No.: 09/166,241

[22] Filed: Oct. 5, 1998

[51] Int. Cl.[6] ..... B65D 35/28

[52] U.S. Cl. ..... 222/103

[58] Field of Search ..... 222/92, 95, 103

[56] References Cited

U.S. PATENT DOCUMENTS

| | | | |
|---|---|---|---|
| 4,159,787 | 7/1979 | Wright . | |
| 4,365,727 | 12/1982 | Shmelkin | 222/103 |
| 4,574,983 | 3/1986 | Atkin | 222/1 |
| 4,778,082 | 10/1988 | Vitelle | 222/95 |
| 5,071,036 | 12/1991 | Kelly et al. | 222/103 |
| 5,222,629 | 6/1993 | Tal | 222/103 |
| 5,330,077 | 7/1994 | Swanson | 222/95 |
| 5,743,434 | 4/1998 | Light | 222/103 |

*Primary Examiner*—Joseph A. Kaufman
*Attorney, Agent, or Firm*—Albert O. Cota

[57] ABSTRACT

A device (10) which attaches to a tube dispenser (106) containing a viscous liquid (110). when the attached device (10) is grasped and pushed forward, the rear section of the dispenser (106) is flattened causing the remaining liquid to be displaced near the front end of the dispenser (106). The device (10) includes a rectangular frame having a front section (12), a rear section (24), a right section (36) and a left section (52). Extending downward and inward from the rear section (24) is a ramp (68) extending upward from the upper surfaces (46,62) of the right and left sections (36,52) is a vertical section (84) which adds rigidly to the device (10) and is suitable for applying indicia (112). Between the front section (12) and the vertical section (84) is located a tube insertion slot (102) and between the vertical section (84) and the ramp (68) is located a tube exit slot (104). The two slots allow the rear section of the tube dispenser (106) to be inserted into the device (10).

19 Claims, 3 Drawing Sheets

DEVICE FOR SQUEEZING A VISCOUS LIQUID FROM A TUBE DISPENSER

TECHNICAL FIELD

The invention pertains to the general field of devices which allow viscous liquids to be dispensed from a tube dispenser. The invention more particularly pertains to a device that when attached to a tube dispenser and the device is moved along the tube, the tube's rear section compresses which displaces the Viscous liquid to the front end of the tube.

BACKGROUND ART

One of the most popular and practical means for packaging a product today is a tube dispenser. Many products are neither in a completely solid, nor in a completely liquid form, and therefore must be held within a type of container which conforms to their consistency. For some products, such as hair gel which is typically applied directly onto a person's head or onto a person's hands, a tube dispenser is a convenient way of packaging. But, for a product such as toothpaste, which is only applied onto a toothbrush because of its oral application, a tube dispenser is the logical type of packaging available.

Tube dispensers are usually made of a flexible, resilient material. There are some tube dispensers that are designed to allow a portion of the product to be squeezed out after which, the dispenser returns to its original shape. There are also tube dispensers that conform to the shape that they are squeezed into—a toothpaste tube is a good example of this type of tube dispenser.

Regardless of which type of tube is utilized there is a common problem associated with all tube dispensers. When a product is packaged in a tube dispenser the dispenser is filled to a certain pre-determined level with the product. According to most tube dispenser directions, the dispenser should be grasped and the product within is forced out by a squeezing motion originating from the sealed end of the dispenser. As the product is used the dispenser is emptied of the product. Once a person has squeezed out all of the product within the tube dispenser, the dispenser is discarded. However, no matter how much a person tries, unless they go to extreme means, they will not be able to squeeze out all of the product within the tube dispenser. Often the amount of a product which remains within a seemingly empty tube dispenser is far greater than what appears from the "used" dispenser.

There have been some attempts to remedy this problem but it has still proven difficult to completely empty the product within a tube dispenser. Obviously, if there was some means of accomplishing this it would be a great benefit for all people who utilize one, or more, products that come packaged in a tube dispenser.

A search of the prior art did not disclose any patents that read directly on the claims of the instant invention, however the following U.S. patents are considered related:

| U.S. Pat. No. | INVENTOR | ISSUED |
|---|---|---|
| 5,222,629 | Tal, Z. | June 29, 1993 |
| 5,071,036 | Kelly, H., et al | Dec. 10, 1991 |
| 4,574,983 | Faatkin, H. | March 11, 1986 |
| 4,159,787 | Wright, S. | July 3, 1979 |

The U.S. Pat. No. 5,222,629 patent discloses a device for removing a desired quantity of a pasty substance contained in a flexible tube. The device consists of an integral structure which includes two elongated members at least one of which is resilient. The elongated members define an opening which gradually narrows from a relatively wide entrance to a narrow slot, and are each separated from the connecting frame by a second slot permitting a resilient movement of at least one of the elongated members. A desired quantity of the content of the tube is expelled by pressing the two elongated members toward each other.

The U.S. Pat. No. 5,071,036 patent discloses an extrusion aid which consists of a strip of a low friction material, such as a Polymer, but which is sufficiently rigid to deform the flexible wall of a tube containing paste or fluid. The strip is provided with an elongated slot which is wider at its ends and that terminates in part-circular walls. The part-circular walls are spaced apart to accommodate the edges of a tube after extrusion takes place.

The U.S. Pat. No. 4,574,983 patent discloses an accumulator device that is threaded over a closed end of a partially emptied collapsible tube dispenser. The device includes a flat body member and at least two slots through the member. The slots are positioned parallel to each other so that when the flattened portion of a partially emptied tube is pulled through one slot and against the edge of the slot, the material in the tube is pushed toward the open end. By inserting the closed end through the other slot and pulling up the slack to form a reverse bend, the material remaining in the tube is trapped therein.

The U.S. Pat. No. 4,159,787 patent discloses a clamp device for evacuating the contents of a flexible tube dispenser. The device includes upper and lower arm portions having a straight trailing side, a forward side having a centrally located curved portion, and opposing arcuate surfaces such that the arm portions are thickest at their centers. End members maintain the separation of the arm portions. In one embodiment, the arm portions are permanently affixed to the end members. In a second embodiment, the lower arm portion is latchably connected to one of the end members.

For background purposes and as indicative of the art to which the invention is related reference may be made to the remaining cited patents.

| U.S. Pat. No. | INVENTOR | ISSUED |
|---|---|---|
| 1,291,228 (GB) | Monk | Oct. 4, 1972 |
| 3,289,892 | Sencabaugh | Dec. 6, 1966 |
| 1,482,872 (FR) | Hirsch | Feb. 11, 1966 |

DISCLOSURE OF THE INVENTION

In its most basic preferred design the device for squeezing a viscous liquid from a tube dispenser is comprised of a rectangular frame having a front section, a rear section, a right section and a left section. To the frame is integrally attached a ramp and a vertical section.

The ramp extends downward and inward from the rear section and terminates at a terminus located rearward from a longitudinal center line. The ramp has a width with a right edge and a left edge. The right edge includes a right sidewall which interfaces with the right section. Likewise the left edge includes a left sidewall which interfaces with the left section. The ramp can be molded with a straight or a curved inner surface.

The vertical section, which is located forward of the longitudinal center line, includes an upper surface and a lower surface, with the lower surface attached to the upper surfaces of right section and the left section.

Between the front section and the vertical section is located a tube insertion slot, and between the vertical section and the ramp is located a tube exit slot. Both slots are dimensioned to slidably receive a compressed end section of the tube dispenser. The tube is initially inserted into the tube insertion slot and then into and out the tube exit slot. The ramp functions to guide the compressed end of the tube out of the tube exit slot.

When the device is grasped by a person's fingers and pushed forward, along the tube dispenser, the viscous liquid in the tube is forced to move in a forward direction. The device also functions as a barrier to prevent the viscous liquid from moving in a rearward direction. As the device is pushed along the tube dispenser the section of the tube dispenser compressed by the device is left substantially flat and void of the viscous liquid.

It is therefore the primary object of the invention to provide a means by which a viscous liquid located within a tube dispenser can be easily, quickly and thoroughly dispensed for use. By using only one's hands and fingers to force a viscous liquid from a tube dispenser it is usually impossible to completely dispense all of the liquid from the tube. The instant invention allows much more of the liquid to be dispensed by applying a strong, uniform pressure along the entire length of the tube dispenser.

In addition to the primary object of the invention it is also an object to provide a device for squeezing a viscous liquid from a tube dispenser that:

- is easy to use,
- can be taken anywhere and easily stored in small spaces,
- can be used in combination with a tube dispenser as a marketing aid,
- can be sold with indicia to advertise a particular product,
- can be marketed to many various types of and groups of individuals, clubs, organization, etc. and
- is cost effective from both a manufacturer's and consumer's point of view.

These and other objects and advantages of the present invention will become apparent from the subsequent detailed description of the preferred embodiment and the appended claims taken in conjunction with the accompanying drawings.

BEST MODE FOR CARRYING OUT THE INVENTION

The best mode for carrying out the invention is presented in terms of a preferred embodiment for a device that allows a viscous liquid to be squeezed from a tube dispenser. The device can be utilized with most pliable tube dispensers, such as those used for toothpaste, and is designed for ease of use.

Figure 1:
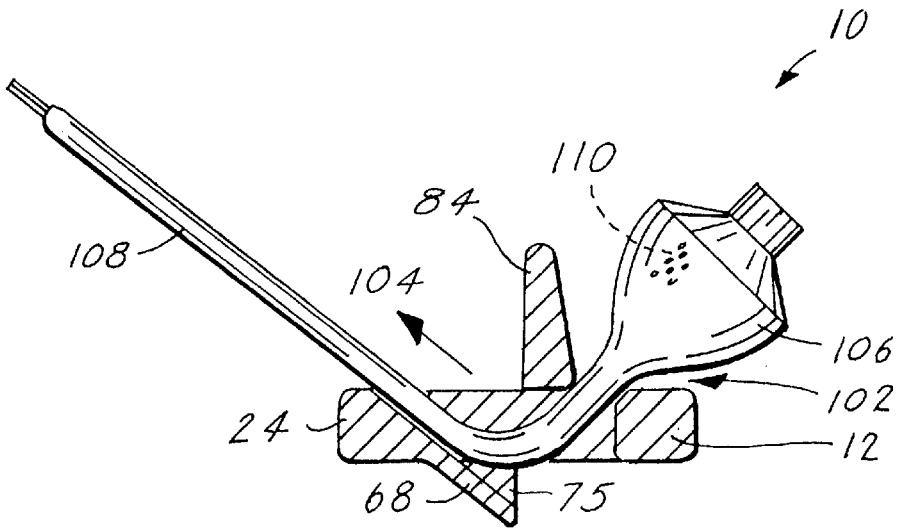
FIG. 1 is a side elevational-sectional view of a device for squeezing a viscous liquid from a tube dispenser. The figure shows the device attached to a dispenser having a rear portion which has been flattened by the device and is substantially void of the viscous liquid.

The preferred embodiment of the device for squeezing a viscous liquid from a tube dispenser 10, (hereinafter "device 10"), as shown in FIGS. 1–6, is comprised of the following major elements: a front section 12, a rear section 24, a right section 36, a left section 52, a downward and inward sloping ramp 68, a vertical section 84, a tube insertion slot 102, and a tube exit slot 104. For descriptive and illustrative purposes, a typical tube dispenser 106 is shown in FIG. 1.

The device 10 is preferably injection-molded of a plastic material, which can be clear or in various colors. The device 10 is structurally comprised of the six sections 12, 24, 36, 52, 68 and 84.

Figure 2:
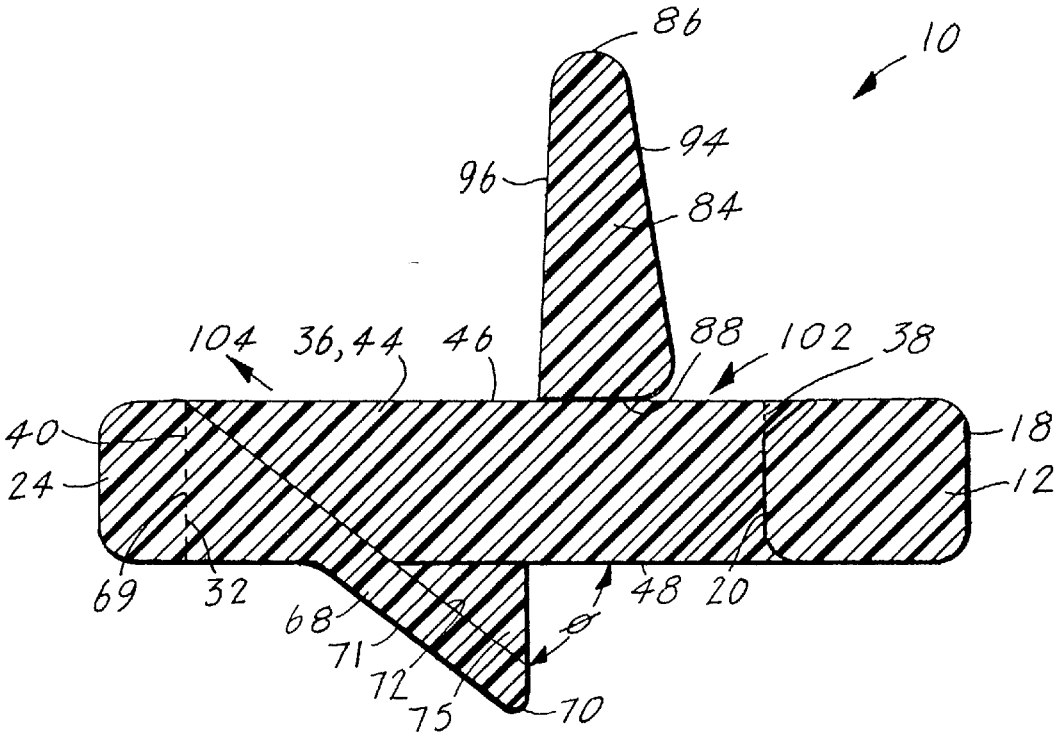
FIG. 2 is a side elevational-sectional view of the device having a downward and inward sloping ramp with a straight inner surface.
Figure 3:
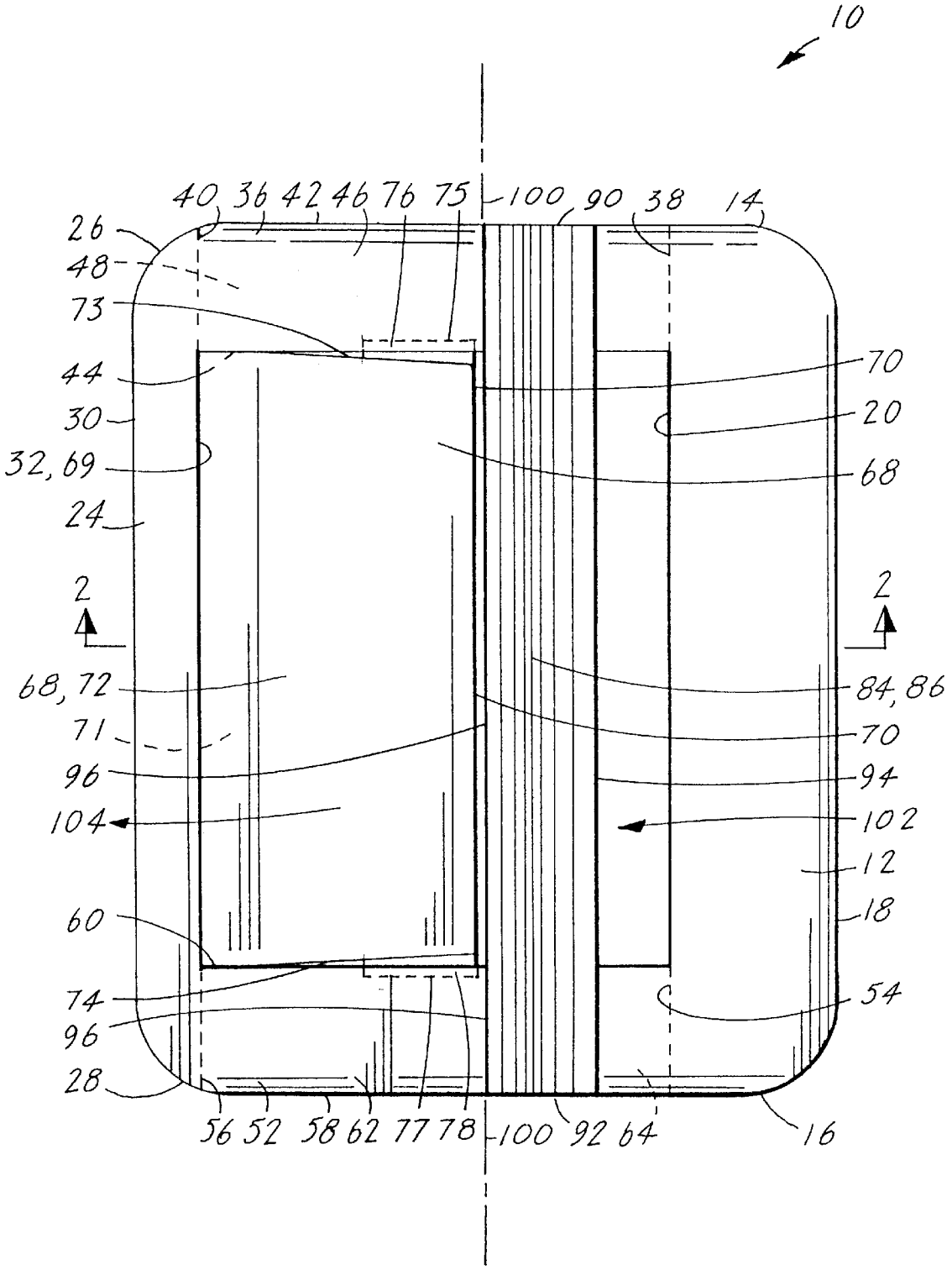
FIG. 3 is a top plan view of the device showing with reference to a longitudinal center line, the relative location of the ramp and a vertical section.
Figure 4:
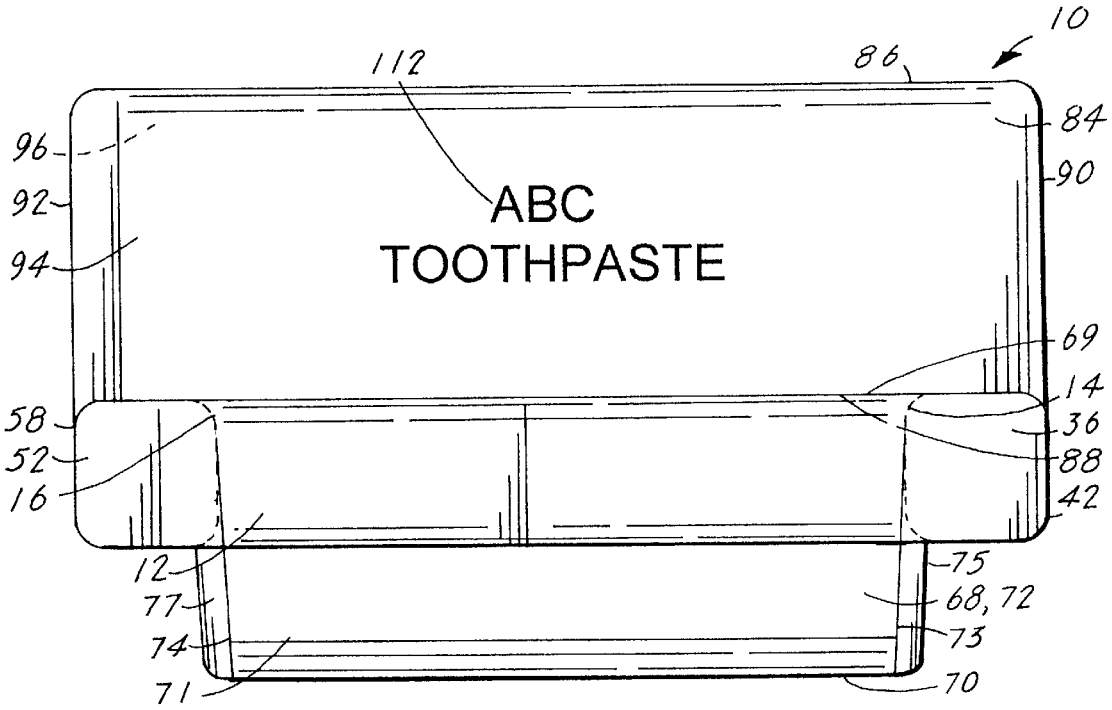
FIG. 4 is a front elevational view of the device showing a vertical section which includes advertising indicia.

The front section 12, as shown in FIGS. 2, 3, and 4, has a right end 14, a left end 16, an outer surface 18, and an inner surface 20. The rear section 24, as shown in FIGS. 2 and 3, is located on the same horizontal plane as the front section 12 and also has a right end 26, a left end 28, an outer surface 30, and an inner surface 32. The right section 36, which is also shown in FIGS. 2 and 3, has a front end 38, a rear end 40, an outer surface 42, an inner surface 44, an upper surface 46, and a lower surface 48. AS shown best in FIG. 3, the front end 38 integrally interfaces with the inner surface 20 and the right end 14 of the front section 12, likewise, the rear end 40 integrally interfaces with the inner surface 32 and the right end 26 of the rear section 24.

The left section 52, as also shown in FIGS. 2 and 37 includes a front end 54, a rear end 56, an outer surface 58, an inner surface 60, an upper surface 62 and a lower surface 64. As shown best in FIG. 3, the front end 54 integrally interfaces with the inner surface 20 and the left end 16 of the front section 12, likewise, the rear end 56 integrally interfaces with the inner surface 32 and the left end 28 of the rear section 24. The result of these elements interfacing gives the device 10 its structural integrity.

Depending on the shape and size of the tube dispenser 106 that is squeezed, either the front section 12 and the rear section 24 have a length that is greater than the length of the right section 36 and the left section 52, thereby forming a rectangle, or the front section 12, the rear section 24, the right section 36 and the left section 52 have equal lengths, thereby forming a square.

To facilitate the attachment of the device 10 to the tube dispenser 106, as shown in FIG. 1, the downward and inward sloping ramp 68 is utilized. As its name implies the ramp 68, as shown best in FIGS. 2 and 3, slopes downward, with respect to the right and left sections 36,52 at an angle $\phi$ ranging from 15° to 60°, with an angle of 35° preferred. The ramp 68 is comprised of a rear edge 69 and a terminus 70. The rear edge 69 is integrally attached to the inner surface 32 of the rear section 24 and the terminus 70 is located rearward and adjacent to a longitudinal center line 100 as shown in FIG. 3. The ramp 68 also includes an outer surface 71, an inner surface 72, an inward tapering width having a right edge 73 and a left edge 74, a right sidewall 75 having an upper surface 76 and a left sidewall 77 having an upper surface 78. The right edge 73 and left edge 74 are positioned respectively against the inner surface 44 of the right section 36 and the inner surface 60 of the left section 52, as shown in FIG. 3.

The right sidewall 75 extends vertically upward from the right edge 73 and terminus 70 with the upper surface 76 interfacing with the lower surface 48 of the right section 36.

Likewise, the left sidewall 77 extends vertically upward from the left edge 74 and terminus 70 with the upper surface 78 interfacing with the lower surface 64 of the left section 52 as shown in FIGS. 2, 3 and 4.

Figure 5:
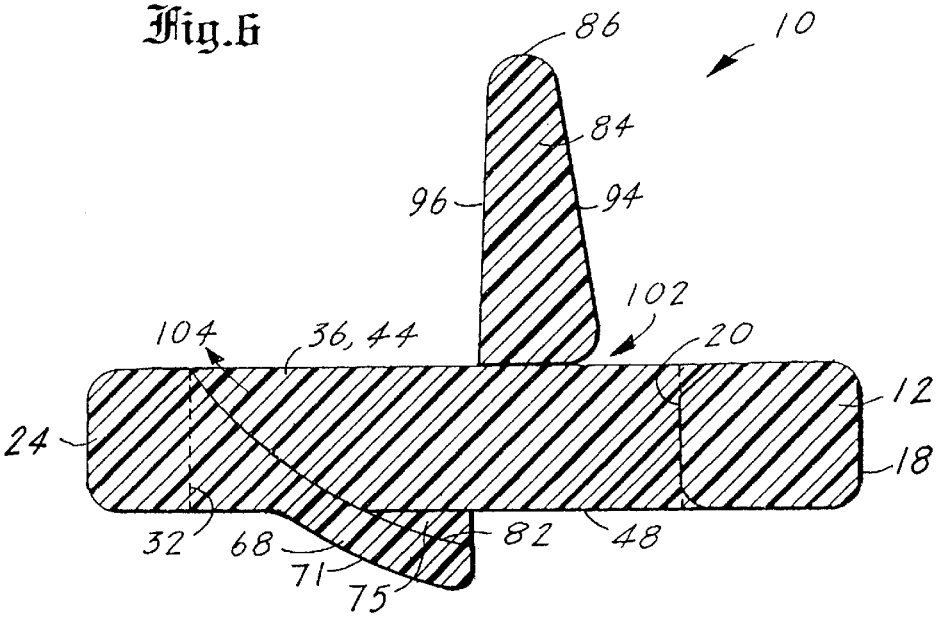
FIG. 5 is a side elevational-sectional view of the device having a ramp with an inwardly curved inner surface.

The ramp 68 is preferably molded with a straight inner surface 72, as shown in FIG. 2. Alternatively, the ramp 68 can be molded with a curved inner surface 82, as shown in FIG. 5. In either design, the ramp 68 in combination with the right and left sidewalls 75,77 fulfills its purpose of aiding the compressed end section 108 of the tube dispenser 106 to be guided out of the tube exit slot 104, as shown in FIG. 1.

To aid in maintaining the device 10 properly positioned on the tube dispenser 106 and to provide additional structural integrity the vertical section 84 is utilized. The vertical section 84, as shown in FIGS. 2, 3 and 4, is comprised of an upper surface 86, a lower surface 88, a right surface 90, a left surface 92, a front surface 94, a rear surface 96 and preferably has a cross section that tapers upward as shown in FIG. 2. Additionally, the front surface 94 and the rear surface 96 have a height which allows amusing, company or advertising indicia 112 to be imprinted thereon, as shown in FIG. 4.

As shown in FIGS. 2 and 4, the lower surface 88 of the vertical section 84 is integrally attached to the respective upper surface 46 of the right section 36 and the upper surface of the left section 52, with the right surface 90 in alignment with the outer surface 42 of the right section 36, and the left surface 92 in alignment with the outer surface 58 of the left section 52. As shown in FIG. 3, the rear surface 96 is located forward of the longitudinal center line 100, and between the front section 12 and the vertical section 84 is located the tube insertion slot 102. Between the downward and inward sloping ramp 68 and the vertical section 84 is located the tube exit slot 104. Both of the slots 102,104 are dimensioned to allow a compressed end section 108 of the tube dispenser 106 to be sequentially inserted into the tube insertion slot 102 and out the tube exit slot 104 as shown in FIG. 1.

In order to use the device 10, the device is grasped by the fingers and pushed forward along the tube dispenser 106 as shown in FIG. 1. Any viscous liquid located within the tube dispenser 106 is forced forward from the pressure exerted primarily from the configuration of the tube insertion slot 102. Additionally, the device 10 functions as a barrier which prevents the viscous liquid from moving in a rearward direction. As the device 10 forces the viscous liquid forward and out the front of the tube dispenser 106, the section of the tube dispenser projecting from the rear of the device 10 is left substantially flat and void of the viscous liquid.

Figure 6:
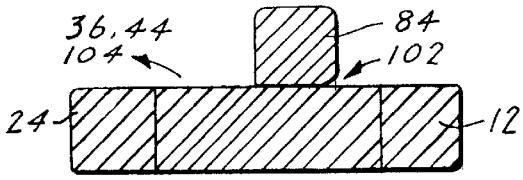
FIG. 6 is a side elevational-sectional view of a device which does not incorporate a ramp.

While the invention has been described in complete detail and pictorially shown in the accompanying drawings it is not to be limited to such details, since many changes and modifications may be made in the invention without departing from the spirit and scope thereof. For example, as shown in FIG. 6, the device 10 can also be made without a ramp 68. In this design. The tube insertion slot 102 is located between the front section 12 and the vertical section 84 and the tube exit slot 104 is located between the vertical section 64 and the rear section 24. This design is particularly adaptable for a tube dispenser 106 that is sold with a device 10 attached. Hence, it is described to cover any and all modifications and forms which may come within the language and scope of the appended claims.

I claim:

1. A device for squeezing a viscous liquid from a tube dispenser, said device comprising:

a) a rectangular frame having a front section, a rear section, a right section and a left section, b) a ramp which extends downward and inward from the rear section and terminates at a terminus located rearward and adjacent to a longitudinal center line, said ramp having a width with a right edge having a right sidewall which interfaces with the right section and a left edge having a left sidewall which interfaces with the left section, and c) a vertical section having an upper surface and a lower surface, wherein the lower surface is attached to the right section and the left section and is located forward of the longitudinal center line, wherein between the front section and said vertical section is created a tube insertion slot and between said vertical section and the ramp is created a tube exit slot wherein said slots are dimensioned to slidably receive a compressed end section of said tube dispenser, wherein when said device is grasped by a person's fingers and pushed forward along said tube dispenser, said device forces the viscous liquid in said tube dispenser to move forward, prevents the viscous liquid from moving rearward and leaves the section of said tube dispenser compressed by said device substantially flat and void of the viscous liquid.

2. The device as specified in claim 1 wherein said device interfaces with said tube dispenser at three points:

a) said front section, b) said vertical section, and c) said ramp, wherein the tube squeezing force applied to said tube dispenser is applied between said front section and said vertical section.

3. The device as specified in claim 1 wherein said rectangle has equal sections thereby forming a square shape.

4. The device as specified in claim 1 wherein said ramp slopes downward, with respect to an upper surface of said front and rear sections, at an angle $\phi$ ranging from 15° to 60°.

5. The device as specified in claim 1 wherein said ramp has an inner surface which is straight.

6. The device as specified in claim 1 wherein said ramp has an inner surface which curves inward.

7. The device as specified in claim 1 wherein said vertical section has a front surface and a rear surface each having sufficient height to allow indicia to be imprinted thereto.

8. The device as specified in claim 1 wherein said device is injected molded of a plastic material.

9. The device as specified in claim 8 wherein said plastic material can be transparent translucent or in various colors.

10. A device for squeezing a viscous liquid from a tube dispenser, said device comprising:

a) a front section having a right end, a left end, an outer surface and an inner surface, b) a rear section located on the same horizontal plane as said front section and having a right end, a left end, an outer surface and an inner surface, c) a right section having a front end, a rear end, an outer surface, an inner surface, an upper surface and a lower surface, wherein the front end integrally interfaces with the inner surface and the right end of said front section, and the rear end integrally interfaces with the inner surface and the right end of said rear section, d) a left section having a front end, a rear end, an outer surface, an inner surface, an upper surface and a lower surface, wherein the front end integrally interfaces with the inner surface and the left end of said front section and the rear end integrally interfaces with the inner surface and the left end of said rear section, e) a downward and inward sloping ramp having a rear edge, a terminus located rearward and adjacent to a longitudinal center line, an outer surface, an inner surface, a right edge, a left edge, a right sidewall and a left sidewall wherein the rear edge integrally extends from the inner surface of said rear section, the right edge and left edge are positioned respectively against the inner surface of said right section and the inner surface of said left section, the right sidewall extends vertically upward from the right edge and terminus, and has an upper surface which interfaces with the lower surface of said right section, likewise, the left sidewall extends vertically upward from the left edge and terminus and has an upper surface which interfaces with the lower surface of said left section, and f) a vertical section having an upper surface, a lower surface, a right surface, a left surface, a front surface and a rear surface, wherein the lower surface is integrally attached to the respective upper surface of said right section and the upper surface of said left section, wherein the right surface is in alignment with the outer surface of said right section and the left surface is in alignment with the outer surface of said left section, wherein the rear surface is located forward of the longitudinal center line, wherein between said front section and said vertical section is located a tube insertion slot and between said downward and inward sloping ramp and said vertical section is located a tube exit slot, wherein said slots are dimensioned to allow a compressed end section of said tube dispenser to be sequentially inserted into the tube insertion slot and out the tube exit slot, wherein when said device is grasped by a person's fingers and pushed forward along said tube dispenser, said device forces the viscous liquid in said tube dispenser to move forward, prevents the viscous liquid from moving rearward and leaves the section of said tube dispenser projecting from the rear of said device substantially flat and void of the viscous liquid.

11. The device as specified in claim 10 wherein said device interfaces with said tube dispenser at three points:

a) said front section, b) said vertical section, and c) said ramp, wherein the tube squeezing force applied to said tube dispenser is applied between said front section and said vertical section.

12. The device as specified in claim 10 wherein said front section and said rear section have a length that is greater than the length of said right section and said left section thereby forming a rectangle.

13. The device as specified in claim 10 wherein said front section, said rear section, said front section and said rear section have equal lengths thereby forming a square.

14. The device as specified in claim 10 wherein said ramp slopes downward, with respect to the surface of said right and left sections, at an angle $\phi$ ranging from 15° to 60°.

15. The device as specified in claim 10 wherein the inner surface of said ramp is straight.

16. The device as specified in claim 10 wherein the inner surface of said ramp has an inward curve.

17. The device as specified in claim 10 wherein said vertical section has a cross section that tapers upward.

18. The device as specified in claim 17 wherein the front surface and the rear surface of said vertical section have a height which allows indicia to be imprinted thereto.

19. The device as specified in claim 10 wherein said device is injected molded of a plastic material.

* * * * *